US011139591B2

(12) United States Patent
Nakai

(10) Patent No.: US 11,139,591 B2
(45) Date of Patent: Oct. 5, 2021

(54) CONDUCTIVE MEMBER

(71) Applicant: SUMITOMO WIRING SYSTEMS, LTD., Yokkaichi (JP)

(72) Inventor: Hirokazu Nakai, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 62 days.

(21) Appl. No.: 16/500,064

(22) PCT Filed: Mar. 26, 2018

(86) PCT No.: PCT/JP2018/012032
§ 371 (c)(1),
(2) Date: Oct. 1, 2019

(87) PCT Pub. No.: WO2018/190110
PCT Pub. Date: Oct. 18, 2018

(65) Prior Publication Data

US 2021/0104823 A1 Apr. 8, 2021

(30) Foreign Application Priority Data

Apr. 14, 2017 (JP) ..... JP2017-080373

(51) Int. Cl.
*H01R 4/20* (2006.01)
*H01R 4/60* (2006.01)
*H01R 4/18* (2006.01)

(52) U.S. Cl.
CPC ..... *H01R 4/183* (2013.01); *H01R 4/60* (2013.01)

(58) Field of Classification Search
CPC . H01R 4/183; H01R 4/20; H01R 4/60; H01R 4/72
(Continued)

(56) References Cited

U.S. PATENT DOCUMENTS 4,829,146 A * 5/1989 Duve ..... H01R 4/20 174/84 C
4,969,845 A * 11/1990 Hauchard ..... H01R 11/11 439/750
(Continued)

FOREIGN PATENT DOCUMENTS

JP 2007-128800 A 5/2007
JP 2007128800 A * 5/2007 ..... H01R 4/20
(Continued)

OTHER PUBLICATIONS

Jun. 12, 2018 International Search Report issued in International Patent Application No. PCT/JP2018/012032.
(Continued)

*Primary Examiner* — Timothy J Thompson
*Assistant Examiner* — Guillermo J Egoavil
(74) *Attorney, Agent, or Firm* — Oliff PLC

(57) ABSTRACT

A conductive member includes (i) a conductive pipe and (ii) a conductor that is inserted into the pipe and is brought into electro-conductive contact with an inner surface of the pipe. The pipe is provided with a stopper section that abuts against and stops the conductor and thereby regulates an insertion amount of the conductor. The conductor includes an insulation coating surrounding a conductor section, the conductor section is exposed at an end portion, and an end of the insulation coating forms a step with respect to the conductor section and creates a stopped section that abuts against and is stopped by the stopper section.

8 Claims, 4 Drawing Sheets

(58) Field of Classification Search
USPC ..... 174/74 R
See application file for complete search history.

(56) References Cited

U.S. PATENT DOCUMENTS

| | | | | |
|---|---|---|---|---|
| 2004/0029454 | A1* | 2/2004 | Onuma | H01R 11/28 439/747 |
| 2006/0196033 | A1* | 9/2006 | Ficker | B23P 15/003 29/508 |
| 2008/0217055 | A1* | 9/2008 | Gumley | H01R 4/206 174/840 |
| 2010/0147585 | A1* | 6/2010 | Kobayashi | H01R 4/186 174/84 C |
| 2020/0169010 | A1* | 5/2020 | Nakai | H01R 11/12 |

FOREIGN PATENT DOCUMENTS

| | | | | |
|---|---|---|---|---|
| JP | 3144604 | U * | 9/2008 | H01R 4/20 |
| JP | 3144604 | U | 9/2008 | |
| JP | 2016-219104 | A | 12/2016 | |

OTHER PUBLICATIONS

Nov. 8, 2018 International Preliminary Report on Patentability issued in International Patent Application No. PCT/JP2018/012032.

* cited by examiner

CONDUCTIVE MEMBER

This invention relates to a conductive member to be routed in a vehicle or the like.

BACKGROUND

A conductive member according to JP Published Patent Application No. 2016-219104A is provided with (i) a conductive pipe member, (ii) a coated wire connected to a longitudinal end of the pipe member, and (iii) a connection member that connects the coated wire and the pipe member. At a tip end of the coated wire, a coating is peeled off, and a core wire is exposed. The connection member is provided with a concave section that opens at a coated wire side, and the core wire is accommodated in the concave section. A peripheral wall section of the concave section surrounds one end side of the core wire, is crimped over the entire circumference by hexagonal caulking or the like, and is crimped to one end side of the core wire. Thus, the core wire and the connection member are configured to be conductively connected.

SUMMARY

In the above case, an end face of one end side of the core wire abuts a back wall of the concave section, whereby an insertion amount of the core wire with respect to the concave section is regulated. However, there is a situation such that the number of components increases because the connection member is arranged. In contrast, if there is no connection member, the pipe runs through in the longitudinal direction. Thus, the insertion amount of the core wire is not fixed to a specified value, and there is a possibility that a total length of a wire harness may vary for each conductive member.

This invention was completed based on the above situation. An object is to provide a conductive member that can minimize variation in length without increasing the number of components.

A conductive member of this invention includes (i) a conductive pipe and (ii) a conductor that is inserted into the pipe from an opening at a longitudinal end (that is, an end of the pipe in a lengthwise direction) and is brought into electro-conductive contact with an inner surface of the pipe, wherein the pipe is provided with a stopper section that abuts and stops the conductor and thereby regulates the insertion amount of the conductor. The conductor includes an insulation coating surrounding a conductor section, the conductor section is exposed at an end portion, and an end of the insulation coating forms a step with respect to the conductor section and creates a stopped section that abuts against and is stopped by the stopper section.

By the conductor being abutted against and stopped by the stopper section, an amount of insertion of the conductor into the pipe is regulated. Thus, it is possible to suppress variation in length for each conductive member. In particular, the stopper section is arranged in the pipe, so the number of components does not increase. Additionally, by using the insulation coating of the conductor, the abutment and stopping structure can be easily realized.

DETAILED DESCRIPTION OF EMBODIMENTS

Preferred embodiments of this invention are shown below.

It is beneficial if the stopper section is configured such that the pipe is recessed radially inward. According to this, the stopper section can be easily formed. Furthermore, by confirming the position of the stopper section on the outer surface of the pipe, the amount of insertion of the conductor can be easily known.

The stopper section may be provided at a section excluding the longitudinal end of the pipe. If the stopper section is provided at the longitudinal end of the pipe, the conductor may be damaged by interfering with an opening edge or a fracture surface of the longitudinal end of the pipe. In that regard, if the stopper section is configured such that the pipe is recessed radially inward at a section excluding the longitudinal end of the pipe, as in this configuration, when the conductor interferes with the stopper section, it is less likely to be damaged.

The portion in the stopper section that abuts against and stops the conductor may be formed disposed along a radial direction so as to be aligned at the same longitudinal position over the entire circumference with respect to the pipe.

Embodiment 1

Figure 1:
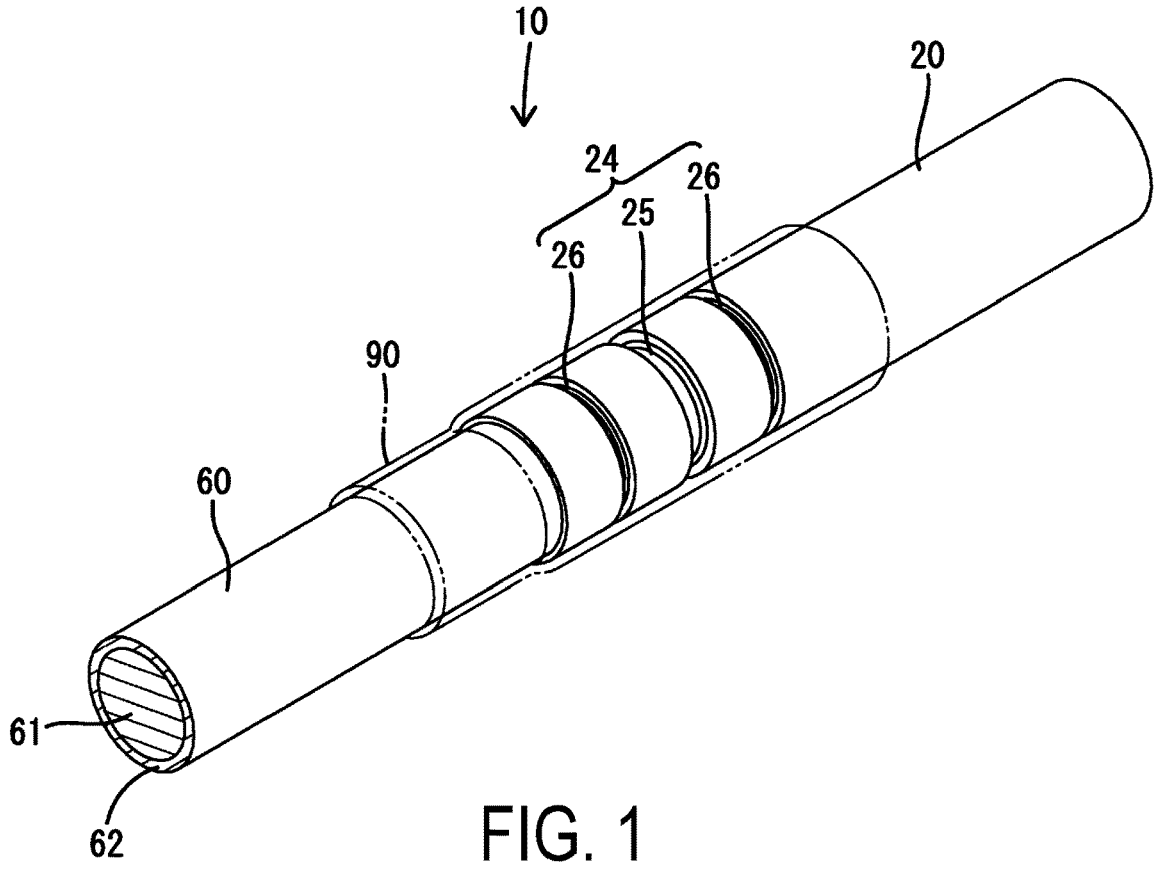
FIG. 1 is a perspective view of a conductive member of embodiment 1 of this invention.
Figure 2:
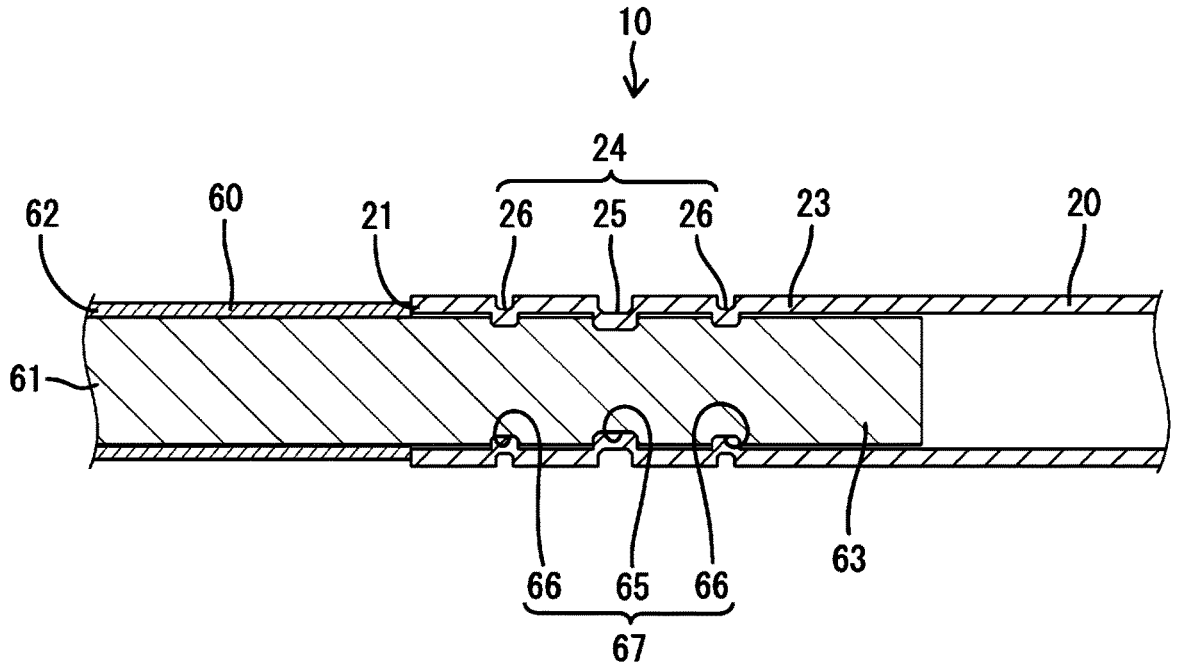
FIG. 2 is a cross-sectional view of the conductive member of embodiment 1.
Figure 3:
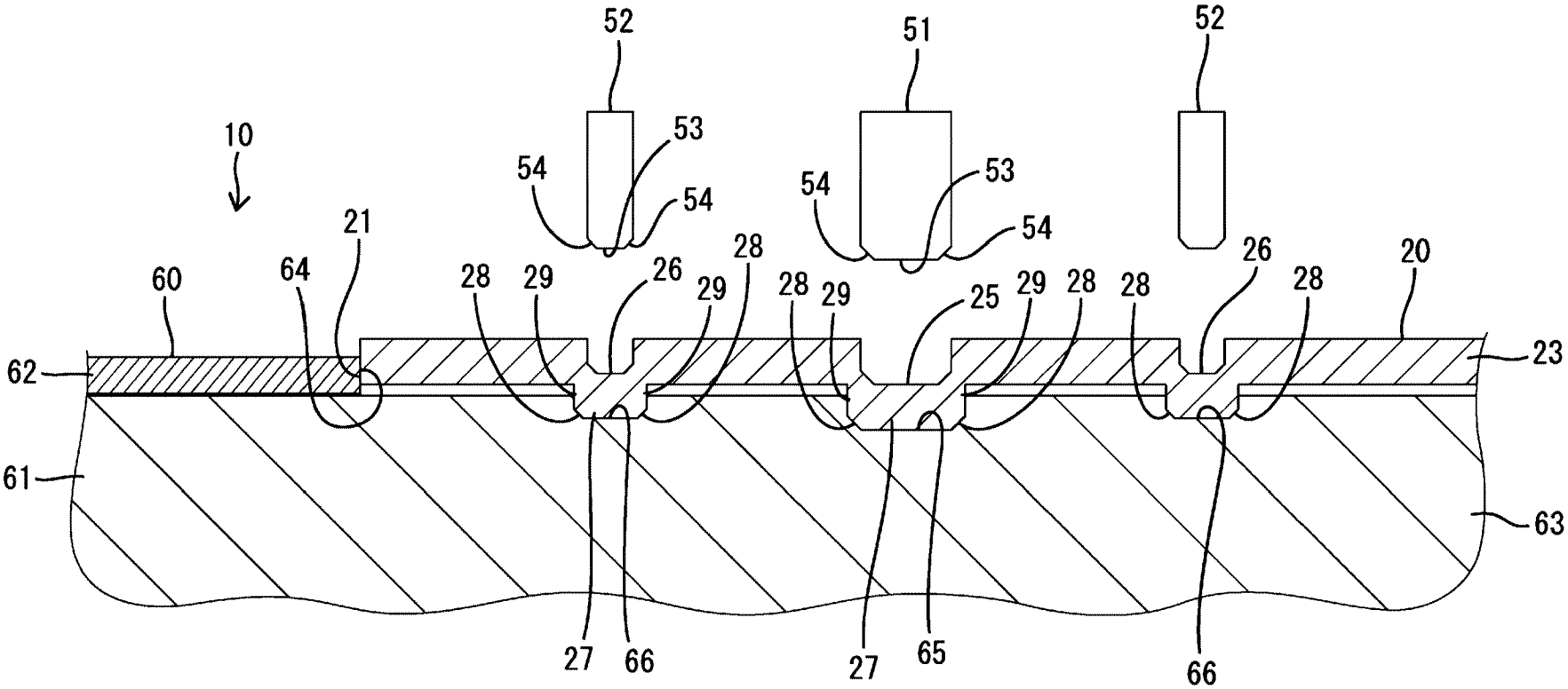
FIG. 3 is an enlarged cross-sectional view of the conductive member of embodiment 1, immediately after molds for forming concave sections are separated.

The following explains embodiment 1 with reference to FIGS. 1-3. A conductive member 10 of embodiment 1 (i) constitutes, for example, a wire harness to be routed in a vehicle such as a hybrid vehicle, an electric vehicle, or the like and (ii) is provided with a pipe 20 and a conductor 60. The pipe 20 and the conductor 60 each have (i) rigidity that maintains a specified shape and (ii) conductivity that constitutes an electric circuit. In the case of this embodiment 1, the pipe 20 is routed at a longitudinal central portion of a harness pathway, a pair of conductors 60 is arranged at respective ends, in the longitudinal direction, of the harness pathway, and one end of each conductor 60 is overlapped with, and electrically and mechanically connected to, a respective end, in the longitudinal direction, of the pipe 20. However, FIGS. 1-3 show a structure in which one end portion of the corresponding conductor 60 is connected to one end portion, among the two longitudinal end portions, of the pipe 20.

The pipe 20 is made of conductive metal mainly composed of aluminum, copper or the like, has a circular cross-section, and is formed in an elongated tubular shape. As the pipe 20, a pipe formed in a cylindrical (tubular) shape by extrusion molding or the like can be used. The pipe 20 shown in the figures is configured to extend straight in one direction, but may be configured to have an undepicted bending section according to the harness pathway. Such a bending section can be easily bent by a bending machine. The longitudinal end of the pipe 20 is an open end face and is disposed along a radial direction so as to be aligned at the same longitudinal position over the entire circumference. As shown in FIG. 3, the longitudinal end of the pipe 20 is constituted as a later-mentioned stopper section 21 that abuts and stops a stopped section 64 of the conductor 60.

The conductor 60 is a single core wire and is formed in a solid rod shape having a circular cross-section and extending in an elongated manner. Specifically, the conductor 60 is constituted by (i) a single core conductor 61 (conductor section) that is one metal rod and (ii) an insulation coating 62 surrounding an outer periphery of the single core conductor 61.

The single core conductor 61 is mainly made of aluminum or copper, and preferably is made of the same material, or material having the same qualities, as the pipe 20. An outer diameter dimension of the single core conductor 61 is substantially the same as an inner diameter dimension of the pipe 20, and specifically, slightly smaller than the inner diameter dimension of the pipe 20. Additionally, the conductor 60 is hard to bend and has relatively high rigidity, and in the same manner as the pipe 20, can be configured to have a bending section. In the case of the conductor 60, in addition to a bending machine, manual bending is also possible.

At one end portion in the lengthwise direction of the conductor 60, the insulation coating 62 is peeled off over a specified length range, and the single core conductor 61 is exposed. As shown in FIG. 2, an exposed section 63 of the single core conductor 61 is inserted inside the pipe 20 from an opening of the end (stopper section 21) of the pipe 20. In the case of this embodiment 1, the entire exposed section 63 of the single core conductor 61 is configured to be inserted into the pipe 20.

One end of the insulation coating 62 is a peeled end face, is disposed over the entire circumference in a radial direction substantially perpendicular to the outer circumferential surface of the single core conductor 61, and is configured as the stopped section 64 that is abutted and stopped substantially parallel to the stopper section 21 of the pipe 20 when assembled. This stopped section 64 is a step having a diameter dimension smaller than a thickness of the pipe 20. Furthermore, although undepicted, the single core conductor 61 is similarly exposed at the other end of the conductor 60 in the lengthwise direction, and the exposed section at the other end is connected to a stranded wire or a terminal and is guided to a connector or the like.

Next, a method of connecting the pipe 20 and the conductor 60, and a connection structure will be explained. First, one end of the conductor 60 in the lengthwise direction is inserted into the pipe 20. When the stopped section 64 of the conductor 60 abuts against and is stopped by the stopper section 21 of the pipe 20, further insertion of the conductor 60 is restricted, and the entire exposed section 63 of the single core conductor 61 is inserted into the pipe 20 in a fitted state. In that state, swaging is performed to the pipe 20 at an end portion in the lengthwise direction, at a portion overlapping the exposed section 63 in a radial direction (hereafter referred to as an overlapped section 23), and a concave section 24 functioning as a contact section with respect to the conductor 60 is formed. As shown in FIG. 2, in the conductor 60, an opposing concave section 67 is formed which has a shape corresponding to the concave section 24.

In this embodiment 1, as shown in FIG. 3, an upset die (mold) used for swaging is provided with (i) a first upset die 51 and (ii) a pair of second upset dies 52 arranged at respective sides of the first upset die 51 in the lengthwise direction. The above-described concave section 24 is provided with (i) a first concave section 25 formed and molded by the first upset die 51 and (ii) a pair of second concave sections 26 formed and molded by the respective second upset dies 52.

The first upset die 51 and the respective second upset dies 52 are provided with (i) inner end faces 53 extending along the lengthwise direction at a radially inward side, and (ii) slanted faces 54 inclined in a tapered manner toward the inner end faces 53 at both sides in the lengthwise direction.

The inner end face 53 of the first upset die 51 is positioned radially inward of the inner end faces 53 of the respective second upset dies 52 and is longer than the inner end faces 53 of the respective second upset dies 52. Furthermore, the slanted faces 54 of the first upset die 51 are substantially the same as the slanted faces 54 of the respective second upset dies 52 and are slightly longer than the slanted faces 54 of the respective second upset dies 52. Additionally, although undepicted, the first upset die 51 and the respective second upset dies 52 are each arranged so as to leave a plurality of spaces in a circumferential direction.

When swaging is performed, the first upset die 51 and the respective second upset dies 52 move radially inward while rotating the outer periphery of the pipe 20. The inner end face 53 of the first upset die 51 is advanced to and abuts against the overlapped section 23 of the outer circumferential surface of the pipe 20, and by having that abutting section pressed radially inward to cause plastic deformation, the first concave section 25 corresponding to the first upset die 51 is formed at the overlapped section 23. Additionally, while the first concave section 25 is being formed, the inner end faces 53 of the respective second upset dies 52 abut against the overlapped section 23 of the outer circumferential surface of the pipe 20, and by having those abutting sections pressed radially inward to cause plastic deformation, the second concave sections 26 corresponding to the respective second upset dies 52 are formed in the overlapped section 23.

According to the above, in the overlapped section 23 of the pipe 20, the first concave section 25 is formed radially inwardly protruding at a distance from the end in the lengthwise direction (stopper section 21), and the pair of the second concave sections 26 is formed radially inwardly protruding at respective sides, in the lengthwise direction, of the first concave section 25. The first concave section 25 and the respective second concave sections 26 are each constituted by (i) an interior section 27 that extends along the lengthwise direction, corresponding to the inner end face 53, and (ii) a pair of inner ends 29 that is arranged at respective sides, in the lengthwise direction, of the interior section 27 and is arranged in the radial direction, while having a pair of inclined surfaces 28 of an outwardly spreading shape corresponding to the respective slanted faces 54.

The interior section 27 of the first concave section 25 is positioned radially inward of the interior sections 27 of the respective second concave sections 26 and is longer than the interior sections 27 of the respective second concave sections 26. The inclined surfaces 28 of the first concave section 25 are at substantially the same angle as the inclined surfaces 28 of the respective second concave sections 26 and are slightly longer than the inclined surfaces 28 of the respective second concave sections 26. Additionally, the inner ends 29 of the first concave section 25 are longer (deeper) than the inner ends 29 of the respective second concave sections 26. Because of this, an amount of compression with respect to the pipe 20 is such that the first concave section 25 is larger than each of the respective second concave sections 26, and the first concave section 25 is plastically deformed more than each of the respective second concave sections 26.

As the first concave section 25 and the respective second concave sections 26 are formed, a first opposing concave section 65 having a cross-sectional shape corresponding to the first concave section 25 is formed by crushing in the outer circumferential surface of the single core conductor 61 along the first concave section 25. At the same time, a pair of second opposing concave sections 66 having cross-sectional shapes corresponding to the respective second concave sections 26 is formed by crushing at both sides, in the lengthwise direction, of the first opposing concave section 65, along the respective second concave sections 26. Thus, the first concave section 25 and the respective second opposing concave sections 66 overlappingly contact each other over the entire circumference, and the respective second concave sections 26 and the respective second opposing concave sections 66 overlappingly contact each other over the entire circumference, whereby the pipe 20 and the conductor 60 are electrically and mechanically connected to each other. In particular, the first concave section 25 is fitted and locked to the first opposing concave section 65, and the respective second concave sections 26 are fitted and locked to the respective second opposing concave sections 66, thereby reliably suppressing the conductor 60 from slipping out of the pipe 20.

After that, a protection member 90 is put on from the outside over the pipe 20 and the conductor 60, and the space between the stopper section 21 of the pipe 20 and the stopped section 64 of the conductor 60 is made to be fluid-tight. As the protection member 90, for example, a resin layer, a heat shrinkable tube, an insulating tape, or a rubber tube can be used.

As explained above, according to this embodiment 1, the conductor 60 is inserted into the pipe 20 from an opening at the longitudinal end of the pipe 20, and a concave section 24 is formed in the pipe 20, at a section excluding the longitudinal end; thus, an electrical and mechanical connection can be made between the pipe 20 and the conductor 60. Because of this, the contact section of the pipe 20 with respect to the conductor 60 is limited to a specified position, and the connection reliability can be improved without the single core conductor 61 being damaged by an opening edge of the longitudinal end of the pipe 20. In particular, the conductor 60 is plastically deformed into a specified shape along the concave section 24 because the conductor 60 is made of a single core wire having rigidity capable of holding a specified shape. As a result, the connection reliability can be further improved.

Additionally, the concave section 24 has a pair of inclined surfaces 28 that widen outward. Thus, the amount of compression by which the conductor 60 is compressed by the concave section 24 is gradually relaxed along the inclined surfaces 28. Thus, the single core conductor 61 can be more reliably suppressed from being damaged.

Furthermore, the concave section 24 includes the first concave section 25 and a pair of second concave sections 26. These sections are arranged at intervals in the lengthwise direction of the pipe 20. Thus, contact resistance of the contact section (concave section 24) with respect to the conductor 60 can be further stabilized. Additionally, mechanical retention can be improved, and it is possible to suppress the conductor 60 from slipping out of the pipe 20.

Furthermore, in the case of this embodiment 1, as shown in FIG. 3, the first opposing concave section 65 of the single core conductor 61 is formed with high compression by the first concave section 25 with a large amount of recess, and the respective second opposing concave sections 66 of the single core conductor 61 are formed with low compression by the respective second concave sections 26 with a small amount of recess at respective sides, in the lengthwise direction, of the first opposing concave section 65. When swaging is performed, material thickness is well stretched from a high compression side at which the first concave section 25 and the first opposing concave section 65 are positioned to a low compression side at which the respective second concave sections 26 and the respective second opposing concave sections 66 are positioned. Thus, processing accuracy of each of the first concave section 25, the first opposing concave section 65, the respective second concave sections 26, and the respective second opposing concave sections 66 can be improved, and the connection reliability can be further improved.

Additionally, according to this embodiment 1, an amount of insertion of the conductor 60 into the pipe 20 is regulated by the conductor 60 abutting against and being stopped by the stopper section 21. Thus, it is possible to minimize variation in total length of the wire harness for each conductive member 10. In particular, the stopper section 21 is provided integrally with the pipe 20; thus, there is no increase in the number of components.

Furthermore, the conductor 60 includes an insulation coating 62 surrounding the single core conductor 61, and the single core conductor 61 is exposed at the end portion, and the end of the insulation coating 62 forms a step with the single core conductor 61 and creates the stopped section 64 that abuts against and is stopped by the stopper section 21. Thus, the insulation coating 62 can be used to easily realize the abutment and stopping structure. In particular, in the case of this embodiment, the stopper section 21 is formed at the end of the pipe 20 in the lengthwise direction; thus, there is no need to perform special processing as the stopper section 21.

Reference Example 1

Figure 4:
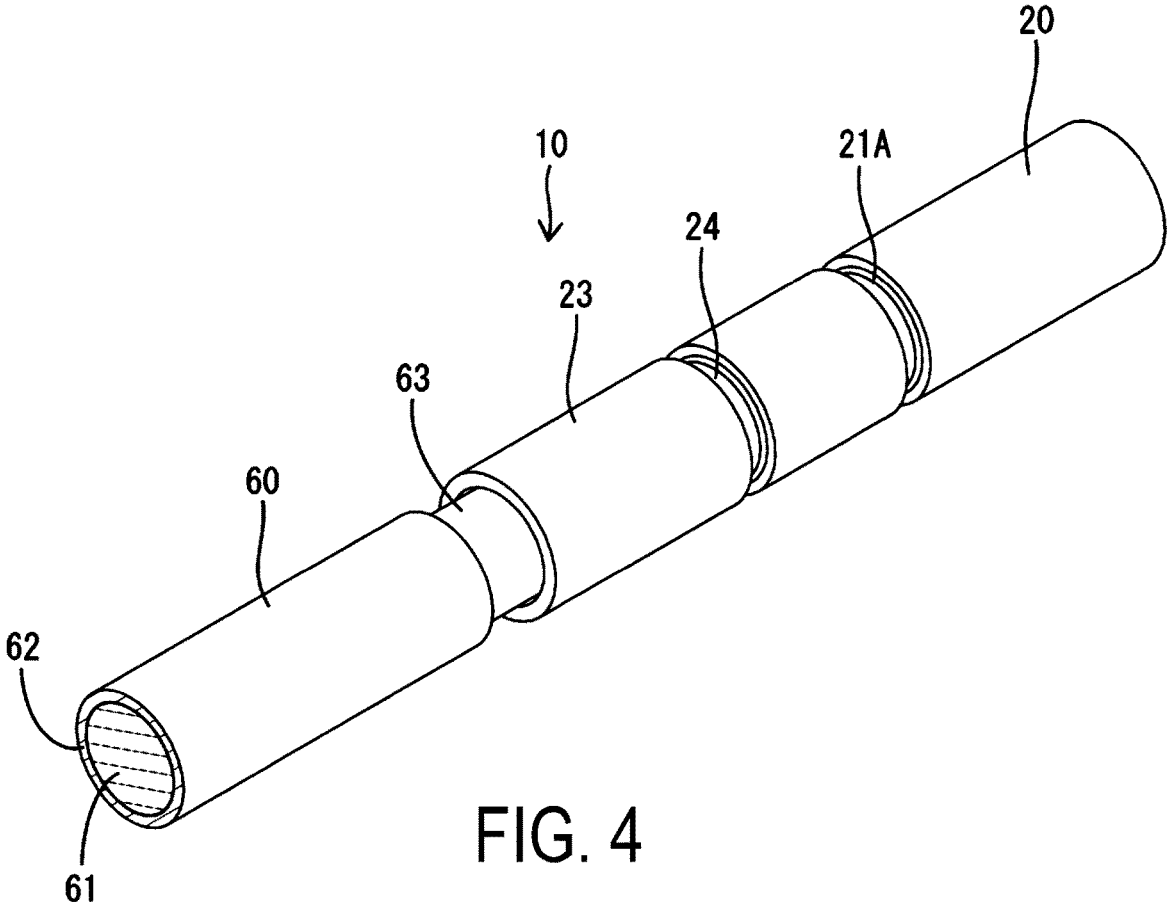
FIG. 4 is a perspective view of a conductive member of reference example 1.
Figure 5:
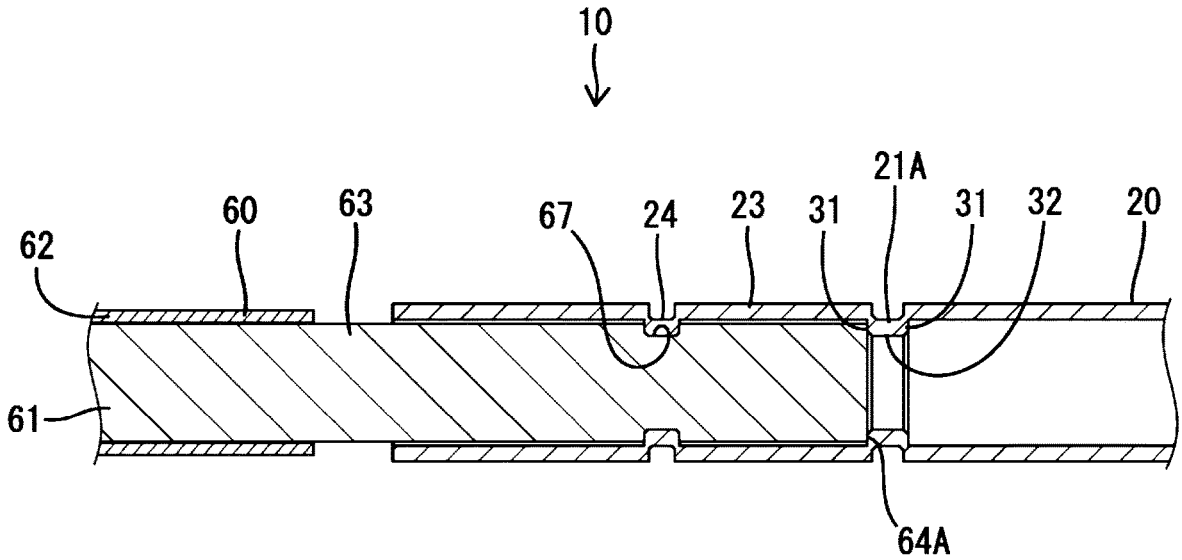
FIG. 5 is a cross-sectional view of the conductive member of reference example 1.

FIGS. 4 and 5 show reference example 1 of this invention. In reference example 1, a structure of a stopper section 21A for regulating the insertion amount of the conductor 60 is different from that of the stopper section 21 of embodiment 1. Furthermore, reference example 1 is different from embodiment 1 also in that the concave section 24 is a single unit, with no distinction between a first concave section and respective second concave sections. Other structures are the same as that of embodiment 1, and the same structures or corresponding structures as embodiment 1 are denoted by the same reference numerals.

The concave section 24 has the same configuration as in embodiment 1, and is provided over the entire circumference away from the longitudinal end of the overlapping section 23 of the pipe 20 (the section in which the pipe 20 overlaps the conductor 60).

The conductor 60 is a single core wire as in embodiment 1. The conductor 60 is connected by inserting into the pipe 20 the single core conductor 61 exposed at the end portion. However, the section inserted into the pipe 20 is not the entire exposed section 63 of the single core conductor 61, but a section excluding a section close to the insulation coating 62 in the exposed section 63 of the single core conductor 61. Because of this, unlike embodiment 1, the insulation coating 62 of the conductor 60 is not abutted against and stopped by the longitudinal end of the pipe 20 and does not function as a stopped section.

In the case of reference example 1, a stopped section 64A is formed at the end of the single core conductor 61. The end of the single core conductor 61 is a tip end surface of the conductor 60 and is disposed so as to be aligned at the same position in the lengthwise direction along the entire circumference.

Meanwhile, the stopper section 21A which abuts against and stops the stopped section 64A is configured in a state in which the section immediately before the overlapping section 23 is recessed radially at a section separated from the longitudinal end of the pipe 20. Specifically, the stopper section 21A is formed to be larger in the lengthwise direction and the radial direction (depth direction) than the concave section 24, and has (i) a pair of opposing end sections 31 extending along the radial direction at both sides, in the lengthwise direction, and (ii) a reduced bottom section 32 extending along the lengthwise direction at the radially inner side. An inner diameter of the reduced bottom section 32 is made smaller than an outer diameter of the conductor 60.

Prior to performing connection work between the pipe 20 and the conductor 60, the stopper section 21A is formed by swaging. At this time, the concave section 24 is not formed in the pipe 20.

Subsequently, one end of the conductor 60 in the lengthwise direction is inserted into the pipe 20. When the stopped section 64A of the conductor 60 is inserted into the pipe 20 and is abutted against and stopped by stopper 21A, further insertion of the conductor 60 is restricted, and the tip end section of the single core conductor 61 (the section excluding the section close to the insulation coating 62) is inserted into the pipe 20 in a fitted state. At this time, the stopped section 64A of the conductor 60 is disposed so as to be able to be connected over the entire circumference to one of the opposing end sections 31.

Next, swaging is performed to the overlapping section 23 of the pipe 20 so as to form the concave section 24, and an opposing concave section 67 having a cross-sectional shape corresponding to that of the concave section 24 is formed at the outer circumferential surface of the single core conductor 61. As a result, the concave section 24 and the opposing concave section 67 overlappingly contact each other over the entire circumference, and the pipe 20 and the conductor 60 are electrically and mechanically connected.

According to reference example 1, the stopper section 21A is configured such that the pipe 20 is recessed inward in the radial direction; thus, it can be easily manufactured by the same swaging as in the concave section 24. Furthermore, by visual recognition or touch recognition of the stopper section 21A recessedly provided on the outer surface of the pipe 20, the amount of insertion of the conductor 60 into the pipe 20 can be easily known.

Additionally, the stopper section 21A is provided at a section excluding the longitudinal end of the pipe 20. Thus, the single core conductor 61 can be suppressed from coming into contact with the opening edge of the pipe 20 or the like to suppress damage or the like.

Reference Example 2

Figure 6:
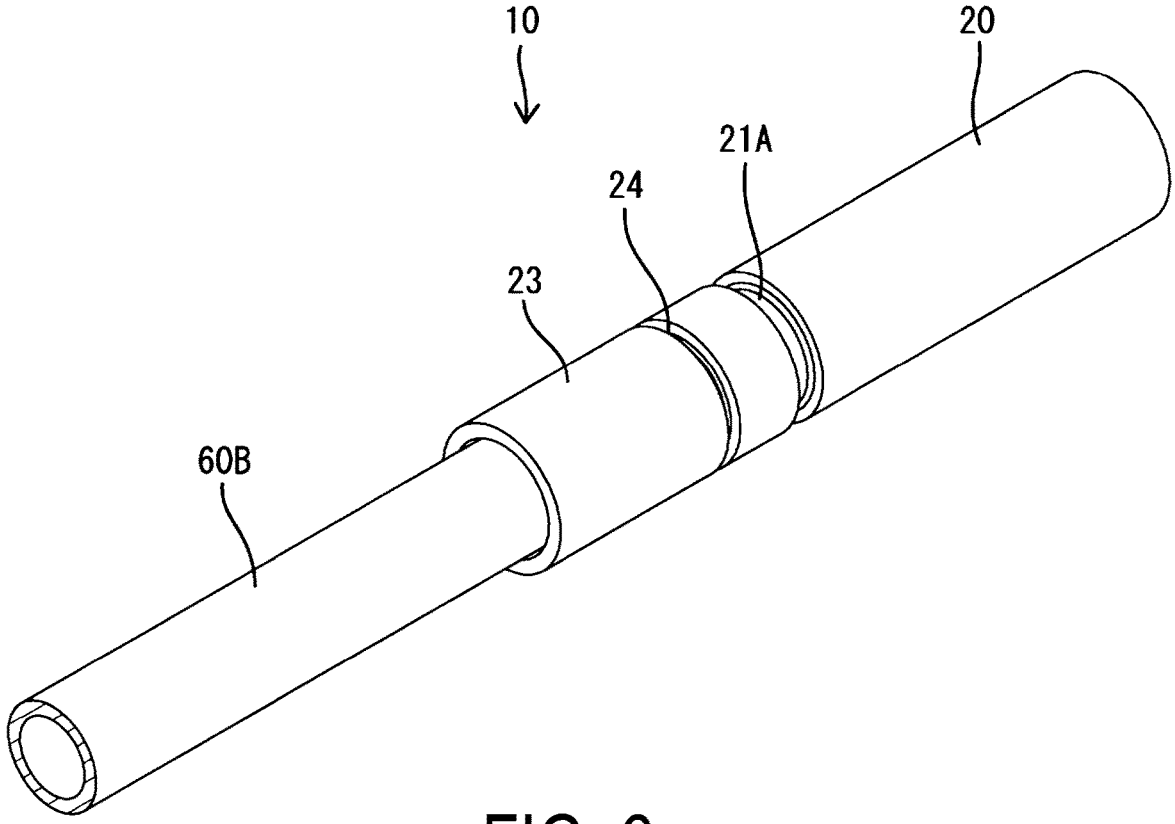
FIG. 6 is a perspective view of a conductive member of reference example 2.
Figure 7:
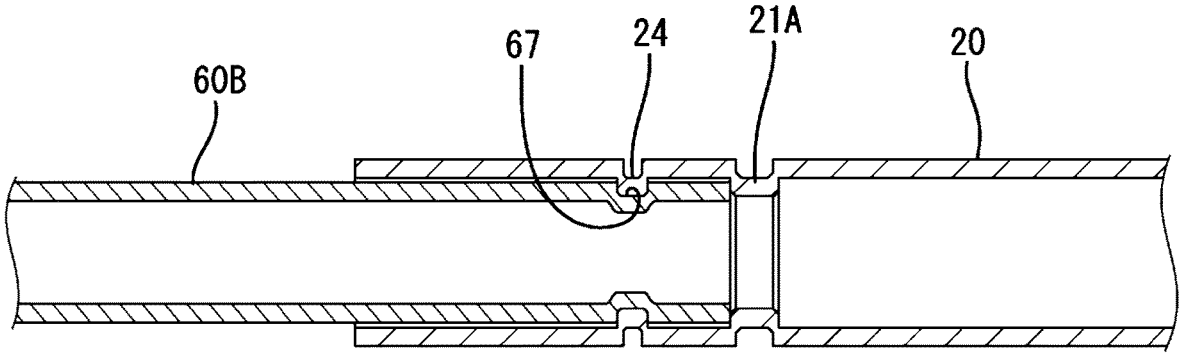
FIG. 7 is a cross-sectional view of the conductive member of reference example 2.

FIGS. 6 and 7 show reference example 2 of this invention. Reference example 2 is different from embodiment 1 and reference example 1 in that the conductor 60 is made of a metal conductive pipe 60B. The structure of the stopper section 21A and the concave section 24 formed in the pipe 20 is the same as that of reference example 1.

The conductive pipe 60B is a circular pipe made of a conductive metal in which aluminum, copper, or the like is used as a main component, preferably made of the same material, or material having the same qualities, as the pipe 20. The conductive pipe 60B has high rigidity, and in the same manner as the pipe 20, can be configured to have a section that is bent by a bending machine and the like. An outer diameter dimension of the conductive pipe 60B is substantially the same as an inner diameter dimension of the pipe 20 and more specifically is slightly smaller than the inner diameter dimension of the pipe 20. One end, in the lengthwise direction, of the conductive pipe 60B is an open end face, and is configured as a stopped section 64B disposed along the radial direction so as to be aligned at the same position in the lengthwise direction over the entire circumference.

When the pipe 20 and the conductor 60 are connected, when the stopped section 64B of the conductive pipe 60B is inserted into the pipe 20 and is abutted against and stopped by the stopper section 21A, further insertion of the conductor 60 is restricted, and thereby a specified length of one end portion, in the lengthwise direction, of the conductive pipe 60B is inserted into the pipe 20 in a fitted state.

Next, swaging is performed to the overlapping section 23 of the pipe 20 so as to form the concave section 24, and the opposing concave section 67 having a cross-sectional shape corresponding to the concave section 24 is formed in the outer circumferential surface of the conductive pipe 60B. As a result, the concave section 24 and the opposing concave section 67 overlappingly contact each other over the entire circumference, and the pipe 20 and the conductor 60 are electrically and mechanically connected.

Other Embodiments

Hereinafter, other embodiments will be briefly described.

(1) As a pipe, an item can also be used that is formed by bending so as to form a plate of conductive metal into a cylindrical (tubular) shape.

(2) A stopper section may be formed at a section excluding the longitudinal end of the pipe, and a stopped section formed at the end of the insulating resin may be inserted into the pipe and abut against and be stopped by the stopper section.

(3) A conductor may be a coated wire using a flexible stranded wire as a conductive section.

(4) A concave section may be configured to be formed at both sides, in the radial direction, of the pipe by being pressed by a pair of molds that can contact each other and/or be separated from each other in the radial direction, instead of swaging.

(5) In reference examples 1 and 2, the stopper section may also be configured to be formed at both sides, in the radial direction of the pipe by being pressed by a pair of molds that can contact each other and/or be separated from each other in the radial direction, instead of swaging.

(6) In embodiment 1, the first upset die and the respective second upset dies may be displaced with a time difference, and for example, the respective second concave sections may be molded after the first concave section is molded.

(7) In embodiment 1, a configuration may also be used such that in addition to the first concave section and the respective second concave sections, a concave section that functions as a contact section is provided.

EXPLANATION OF SYMBOLS

10 Conductive member
20 Pipe

21, 21A Stopper sections
24 Concave section
25 First concave section
26 Second concave sections
60 Conductor
62 Insulation coating
64, 64A, 64B Stopped sections

What is claimed is:

1. A conductive member, comprising:

a conductive pipe; and a conductor that is inserted into the pipe from an opening at a longitudinal end and is brought into electro-conductive contact with an inner surface of the pipe, wherein:

the pipe is provided with a stopper section that abuts against and stops the conductor and thereby regulates an insertion amount of the conductor, the conductor includes an insulation coating surrounding a conductor section, the conductor section is exposed at an end portion, and an end of the insulation coating forms a step with respect to the conductor section and creates a stopped section that abuts against and is stopped by the stopper section, the pipe includes a plurality of concave sections that deform into the conductor and electrically contact the conductor, whereby the pipe and the conductor are electrically and mechanically connected to each other, the pipe has a uniform cross section over its entire length, excluding the concave sections, and the pipe has a length that allows the pipe to be bent according to a pathway of a wiring harness of a vehicle.

2. The conductive member according to claim 1, wherein:

a portion of the stopper section that abuts against and stops the conductor is disposed along a radial direction so as to be aligned at the same longitudinal position over an entire circumference with respect to the pipe.

3. The conductive member according to claim 1, wherein the stopper section is an end face of the pipe.

4. The conductive member according to claim 1, wherein the conductor is a single core wire having rigidity capable of holding a specified shape.

5. The conductive member according to claim 1, wherein the concave sections are spaced from each other in a longitudinal direction of the pipe.

6. The conductive member according to claim 1, wherein one of the concave sections extends farther inward, in a radial direction of the pipe, than another one of the concave sections.

7. The conductive member according to claim 1, wherein each concave section has a pair of inclined surfaces that widen outward, in a radial direction of the pipe.

8. The conductive member according to claim 1, wherein each concave section extends inward, in a radial direction of the pipe, over an entire circumference of the pipe.

* * * * *